US011328683B2

(12) United States Patent
Nagata

(10) Patent No.: US 11,328,683 B2
(45) Date of Patent: May 10, 2022

(54) DISPLAY DEVICE AND SOURCE DRIVER

(71) Applicant: LAPIS Semiconductor Co., Ltd., Yokohama (JP)

(72) Inventor: Daisei Nagata, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 17/164,904

(22) Filed: Feb. 2, 2021

(65) Prior Publication Data

US 2021/0241711 A1 Aug. 5, 2021

(30) Foreign Application Priority Data

Feb. 5, 2020 (JP) ..... JP2020-018040

(51) Int. Cl.
*G09G 3/36* (2006.01)
*G09G 3/3275* (2016.01)

(52) U.S. Cl.
CPC ..... *G09G 3/3688* (2013.01); *G09G 3/3677* (2013.01); *G09G 3/3696* (2013.01); *G09G 3/3275* (2013.01); *G09G 2300/0452* (2013.01); *G09G 2310/0272* (2013.01); *G09G 2310/0286* (2013.01); *G09G 2370/08* (2013.01)

(58) Field of Classification Search
CPC .. G09G 3/3688; G09G 3/3677; G09G 3/3696; G09G 2310/0272; G09G 2300/0452; G09G 2310/0286; G09G 3/3275; G09G 2370/08
See application file for complete search history.

(56) References Cited

U.S. PATENT DOCUMENTS 6,459,417 B1 * 10/2002 Orisaka ..... G09G 3/3688 345/98
7,940,241 B2 * 5/2011 Bae ..... G09G 3/3648 345/98
8,648,788 B2 * 2/2014 Bae ..... G09G 3/3648 345/99
9,007,292 B2 * 4/2015 Ikari ..... G09G 3/20 345/100
9,024,859 B2 * 5/2015 Park ..... G06F 3/038 345/100
9,099,026 B2 * 8/2015 Shiibayashi ..... G09G 3/3685
9,311,861 B2 * 4/2016 Nose ..... G09G 3/3685
9,318,036 B2 * 4/2016 Park ..... G09G 3/3648
9,460,675 B2 * 10/2016 Harada ..... G09G 3/3426
(Continued)

FOREIGN PATENT DOCUMENTS

JP 2006-295588 A 10/2006

*Primary Examiner* — Michael J Jansen, II
(74) *Attorney, Agent, or Firm* — Rabin & Berdo, P.C.

(57) ABSTRACT

A display device has: a display panel; a source driver group including 2j source drivers that are arranged in the lengthwise direction of gate lines; and a display controller that is connected to the 2j source drivers via j data supply lines provided in common between adjacent pairs of source drivers. The display controller outputs j pixel data piece groups, into which m/2 pixel data pieces were divided, to the data supply lines. The (2k)th source driver receives m/(4j) pixel data pieces via a data supply line, and receives three pixel data pieces from the (2k+1)th source driver. The (2k)th source driver generates m/(2j) of gradation voltage signals on the basis of the pixel data pieces.

8 Claims, 7 Drawing Sheets

(56) References Cited

U.S. PATENT DOCUMENTS

| | | | | |
|---|---|---|---|---|
| 9,466,237 | B2 * | 10/2016 | Kim | G09G 3/2044 |
| 9,601,043 | B2 * | 3/2017 | Hikichi | G09G 3/3688 |
| 9,626,929 | B2 * | 4/2017 | Yusa | G09G 3/3685 |
| 9,747,665 | B2 * | 8/2017 | Oho | G09G 5/026 |
| 10,608,017 | B2 * | 3/2020 | Takahashi | G09G 3/2092 |
| 11,056,030 | B1 * | 7/2021 | Melakari | G09G 3/001 |
| 2009/0153541 | A1 * | 6/2009 | Yusa | G09G 3/3685 345/213 |
| 2009/0322661 | A1 * | 12/2009 | Bae | G09G 3/3648 345/87 |
| 2011/0175865 | A1 * | 7/2011 | Bae | G09G 3/3648 345/204 |
| 2012/0249608 | A1 * | 10/2012 | Ikari | G09G 3/20 345/690 |
| 2013/0286003 | A1 * | 10/2013 | Park | G09G 3/3685 345/214 |
| 2014/0085349 | A1 * | 3/2014 | Shiibayashi | G09G 3/3406 345/690 |
| 2014/0104265 | A1 * | 4/2014 | Park | G09G 3/3648 345/214 |
| 2014/0160176 | A1 * | 6/2014 | Nose | G09G 3/3685 345/690 |
| 2014/0292840 | A1 * | 10/2014 | Harada | G09G 3/3426 345/694 |
| 2015/0109348 | A1 * | 4/2015 | Hikichi | G09G 3/3688 345/690 |
| 2015/0179094 | A1 * | 6/2015 | Kim | G09G 3/2044 345/690 |
| 2016/0225124 | A1 * | 8/2016 | Orio | G06T 3/40 |
| 2018/0219025 | A1 * | 8/2018 | Takahashi | G09G 3/2092 |

* cited by examiner

DISPLAY DEVICE AND SOURCE DRIVER

CROSS REFERENCE TO RELATED APPLICATIONS

This application is based upon and claims the benefit of priority of the prior Japanese Patent Application No. 2020-018040, filed on Feb. 5, 2020, the entire contents of which are incorporated herein by reference.

TECHNICAL FIELD

The present invention relates to a display device and a source driver.

BACKGROUND ART

In recent years, display devices compatible with so-called 4K (3840×2160 pixels, for example) resolution have become increasingly popular, but there is not much 4K image content. Thus, when viewing conventional high-definition broadcasts using a 4K-compatible display device, a conversion device such as an up-scan converter is externally connected to the display device to convert the frequency of the image signal before viewing the image, for example.

Also, image signals transmitted through a typical digital broadcast employ interlacing, and thus, in order to view such image signals using a display device compatible with progressive scanning, the image signal needs to be subjected to a conversion process. An image signal processing device that converts the timing of a gate clock signal in order to perform a process of converting an image signal so as to display two horizontal scanning lines from an image signal of one horizontal scanning line has been proposed (Japanese Patent Application Laid-Open Publication No. 2006-295588, for example).

In the future, if display devices compatible with 8K (7680×4320 pixels, for example), which is a high-resolution image format that exceeds high definition and 4K, become popular without much 8K image content, then it is anticipated that the image signal would be similarly converted.

SUMMARY OF THE INVENTION

In large screen display devices, a plurality of source driver ICs collectively function as a source driver. For example, in a 4K display device, 12 source driver ICs output gradation voltage signals for 320 pixels (that is, 960 channels), thereby supplying gradation voltage signals for 3840 pixels to the display panel. Also, in an 8K display device, 24 source driver ICs output gradation voltage signals for 320 pixels, thereby supplying gradation voltage signals for 7680 pixels to the display panel.

In a 4K display device, 12 data supply lines are provided to connect a timing controller to each source driver IC, and the image data signal is supplied through the data supply lines. As described above, if a 4K image signal is to be converted to an 8K image signal (that is, up-converted), then it is necessary to supply image data signals to 24 source driver ICs through 12 data supply lines from the 4K timing controller. Thus, each of the 12 data supply lines is connected to a pair of source driver ICs, having been branched off in the middle of the line into two lines. The image data signals for 960 channels outputted from the timing controller are split according to the branching of the data supply line, and are supplied to the pair of source driver ICs.

The source driver ICs that receive the split image data signals perform interpolation of the pixel data in the horizontal scanning line direction, and each generate gradation voltage signals for 960 channels. In this case, the ends of the source driver ICs (that is, the boundaries between adjacent source driver ICs) also need to undergo pixel data interpolation, and thus, the image data signals to be supplied are not for 480 channels, which is half of 960 channels, but 483 channels, which is three additional channels (that is, a channel for each RGB color).

At this time, one of the pair of source driver ICs connected to a common data supply line can receive image data signals for three additional channels from the timing controller through the data supply line. However, the other source driver IC cannot receive image data signals for the three additional channels.

A first source driver IC and a second source driver IC connected to the same data supply line have supplied thereto image data signals for 1st to 960th channels from the timing controller through the data supply line. Thus, the first source driver IC can receive image data signals for the 481st to 483rd channels in addition to the image data signals for the 1st to 480th channels. By contrast, the second source driver IC can receive the image data signals for the 481st to 960th channels, but image data for the 961st to 963rd channels constitutes image data signals supplied to another data supply line, and thus, the second source driver IC cannot receive the image data.

Thus, there has been a problem that when up-converting from 4K to 8K, image data signals for three channels for interpolation of the pixel data in the horizontal scanning line direction are missing for every pair of source driver ICs.

The present invention takes into consideration the above-mentioned problem, and an object thereof is to provide a display device that can display images up-converted by a plurality of source drivers seamlessly throughout the entire screen.

A display device according to the present invention includes: a display panel having m data lines and n gate lines (m being a multiple of 12 greater than or equal to 24, and n being an integer of 2 or greater), and m×n pixel units provided in a matrix at respective intersections between the m data lines and the n gate lines; a gate driver configured to supply scan signals that control the pixel switches to be ON during a selection period based on a pulse width to the n gate lines; a source driver group that is constituted of 2j source drivers (j being an integer of 2 or greater) arranged along a lengthwise direction of the gate lines, and that is configured to receive one frame of an image data signal formed by a sequence of a plurality of pixel data piece groups that each include m/2 pixel data pieces that each cover R, G, and B pixels and to generate gradation voltage signals to be supplied to the m×n pixel units on the basis of the image data signal; j data supply lines provided in common among pairs of adjacent source drivers that constitute the source driver group; and a display controller that is connected to the 2j source drivers via the j data supply lines, and that is configured to output the image data signal to the j data supply lines for each pixel data piece group formed by sequentially splitting the m/2 pixel data pieces into j groups from the beginning, wherein the pair of source drivers is constituted of a (2k−1)th source driver and a (2k)th source driver (k being a natural number of (j−1) or less), and wherein the (2k)th source driver receives m/(4j) pixel data pieces from the display controller via the data supply line, receives three pixel data pieces that cover the R, G, and B pixels of the (2k+1)th source driver that is adjacent to the (2k)th source driver and that is connected to the display controller via a differing data supply line, and generates m/(2j) of the gradation voltage signals on the basis of the m/(4j) pixel data pieces and the three pixel data pieces.

Also, a source driver according to the present invention is a source driver that is connected to a display panel having a plurality of data lines, a plurality of gate lines and a plurality of pixel units provided in a matrix at each intersection of the plurality of data lines and the plurality of gate lines, a plurality of the source drivers being arranged adjacent to each other in a lengthwise direction of the gate lines, the source driver being configured to receive an image data signal including a plurality of pixel data pieces via a data supply line, and the source driver being configured to generate a gradation voltage signal on the basis of the image data signal, the source driver including: a shift register configured to sequentially acquire a plurality of pixel data pieces from the image data signal supplied via the data supply line; a transmission/reception circuit configured so as to be able to transmit/receive the pixel data pieces to and from adjacent source drivers; a latch circuit configured to latch pixel data pieces outputted from the shift register and pixel data pieces received by the transmission/reception circuit to perform an interpolation process on the pixel data pieces on the basis of the plurality of latched pixel data pieces; and an output circuit configured to generate and output the gradation voltage signals, on the basis of pixel data pieces that have undergone the interpolation process.

According to the display device of the present invention, it is possible to interpolate the pixel data throughout the entire screen.

DETAILED DESCRIPTION OF EMBODIMENTS

Figure 1:
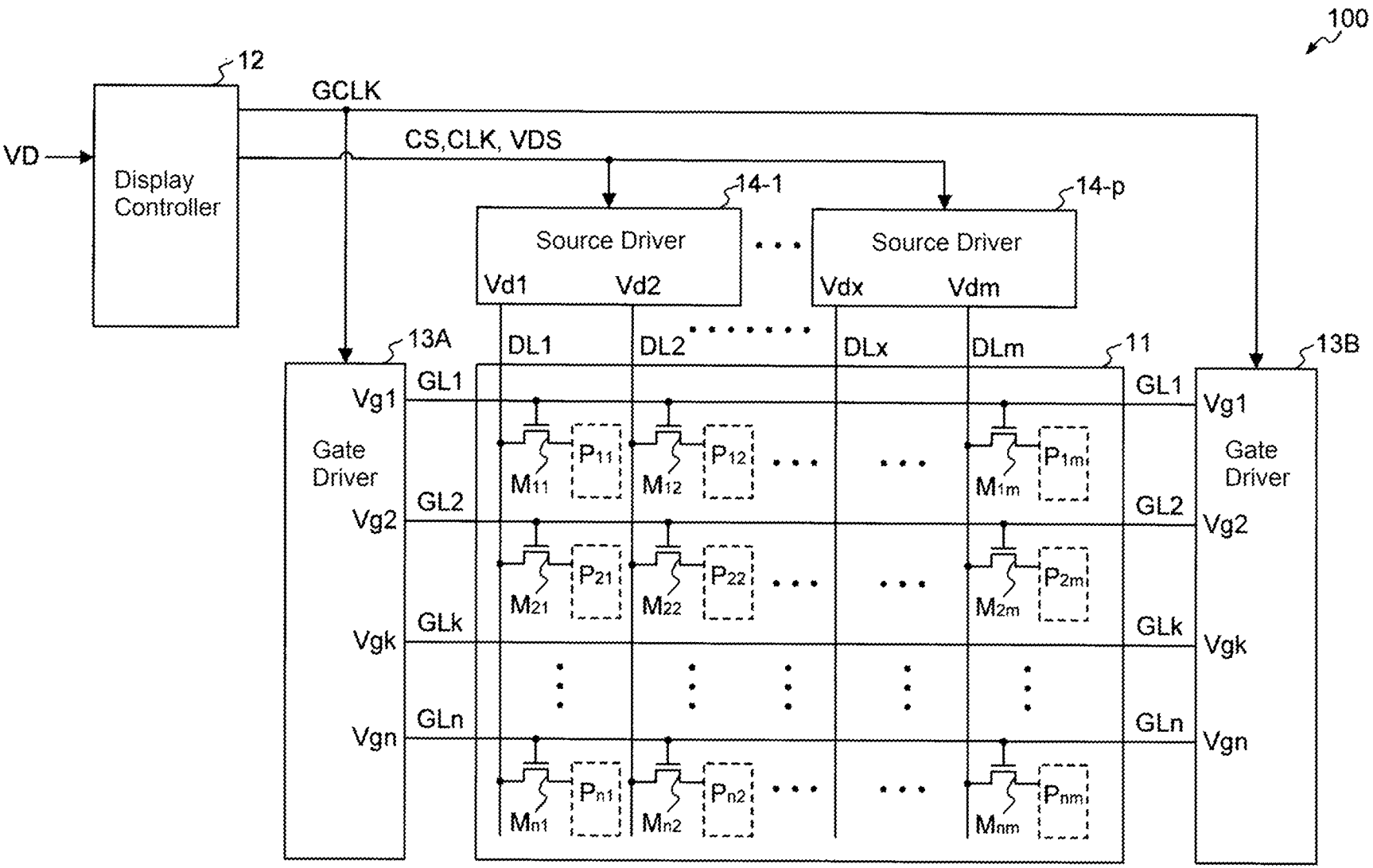
FIG. 1 is a block diagram showing a configuration of a display device of the present invention.

A suitable embodiment of the present invention will be explained below in detail. In the description of embodiments and the affixed drawings below, parts that are substantially the same or equivalent to each other are assigned the same reference characters.

FIG. 1 is a block diagram showing a configuration of a display device 100 of the present invention. The display device 100 is an active matrix driven liquid crystal display device. The display device 100 includes a display panel 11, a display controller 12, gate drivers 13A and 13B, and source drivers 14-1 to 14-*p*.

The display panel 11 is constituted of a semiconductor substrate on which a plurality of pixel units P11 to Pnm and pixel switches M11 to Mnm (n being an integer of 2 or greater and m being a multiple of 12 greater than or equal to 24) are arranged in a matrix of n rows×m columns. The display panel 11 has n gate lines GL1 to GLn that are horizontal scanning lines and m data lines DL1 to DLm that are arranged so as to intersect perpendicularly with the gate lines. The pixel units P11 to Pnm and the pixel switches M11 to Mnm are provided at the respective intersections of the gate lines GL1 to GLn and the data lines DL1 to DLm.

The display panel 11 is a display panel having a so-called 8K resolution defined by a pixel count of 7680×4320, for example. In the 8K display panel, n=4320 and m=7680, with the number of gate lines being 4320 and the number of data lines being 7680.

The pixel switches M11 to Mnm are controlled so as to be turned ON or OFF according to the gate signals Vg1 to Vgn supplied from the gate drivers 13A and 13B. The pixel units P11 to Pnm receive gradation voltage signals Vd1 to Vdm corresponding to the image data from the source drivers 14-1 to 14-*p*. When each of the pixel switches M11 to Mnm is ON, the gradation voltage signal Vd1 to Vdm is supplied to each pixel electrode of the pixel units P11 to Pnm, thereby charging each of the pixel electrodes. Display is performed by controlling the luminance of the pixel units P11 to Pnm according to the gradation voltage signals Vd1 to Vdm in the pixel electrodes of the pixel units P11 to Pnm.

If the display device 100 is a liquid crystal display device, each of the pixel units P11 to Pnm includes a transparent electrode that is connected via a pixel switch to a data line, and liquid crystal that is sealed between the semiconductor substrate and an opposite substrate that is provided so as to oppose the semiconductor substrate and on which one transparent electrode that covers the entire surface thereof is formed. Display is performed by changing the transmittance of the liquid crystal for a backlight inside the display device according to the voltage difference between the gradation voltage signals Vd1 to Vdm supplied to the pixel units P11 to Pnm and the opposite substrate voltage.

The display controller 12 generates an image data signal VDS including a sequence of pixel data pieces PD in which the luminance level of each pixel is represented by 256 luminance gradations of 8 bits, for example, on the basis of the image data VD compatible with 4K image display. The image data signal VDS is configured as an image data signal that was serialized according to the number of transmission paths in each of a prescribed number of data lines.

In the present embodiment, by forming a serial sequence of n/2 pixel data piece groups, each of which includes m/2 pixel data pieces PD, one frame of the image data signal VDS is formed. Through operation of latch circuits of the source drivers 14-1 to 14-*p* to be described later, the gradation voltage signals Vd1 to Vdm to be supplied to the n×m pixel units (that is, the pixel units P11 to Pnm) are generated on the basis of the (m/2)×(n/2) pixel data pieces PD.

Also, the display controller 12 detects a horizontal synchronizing signal from the image data VD, and on the basis thereof, generates a clock signal CLK in which the clock pulse period (hereinafter referred to as a clock period) is constant. The clock signal CLK is in embedded clock mode, for example. Also, the display controller 12 generates a control signal CS including various settings. The display controller 12 integrates the clock signal VDS together with the control signal CS and the clock signal CLK to form a serial signal that is supplied to the source drivers 14-1 to 14-*p*.

Also, the display controller 12 supplies a gate clock signal GCLK to the gate drivers 13A and 13B provided on both ends of the display panel 11.

The gate drivers 13A and 13B supply the gate signals Vg1 to Vgn to the gate lines GL1 to GLn on the basis of the gate clock signal GCLK supplied from the display controller 12.

The source drivers 14-1 to 14-*p* are each formed in a semiconductor IC (integrated circuit) chip. The source drivers 14-1 to 14-*p* constitute a source driver group including 1st stage to pth stage (hereinafter referred to as "last stage") source drivers based on the scanning direction and being disposed along the lengthwise direction of the gate lines.

The source drivers 14-1 to 14-*p* acquire the pixel data pieces PD in the image data signal VDS one horizontal scanning line at a time, generate the gradation voltage signals Vd1 to Vdm corresponding to the luminance gradations indicated in the acquired pixel data pieces PD, and applies the gradation voltage signals to the data lines DL1 to DLm of the display panel 11.

The source drivers 14-1 to 14-*p* are each provided for a prescribed number of data lines that are grouped by dividing the data lines DL1 to DLm according to the resolution of the display panel 11. If the display panel 11 is an 8K panel, for example, the source drivers are constituted of 24 source driver ICs (that is, p=24) that each drive 960 data lines.

The source drivers 14-1 to 14-*p* have channel outputs corresponding in number to the number of data lines driven by each source driver. That is, source driver ICs for an 8K panel each have 960 channels of output. Of the 960 channels of output, three channels each correspond to three pixels of R (red), G (green), and B (blue).

Figure 2:
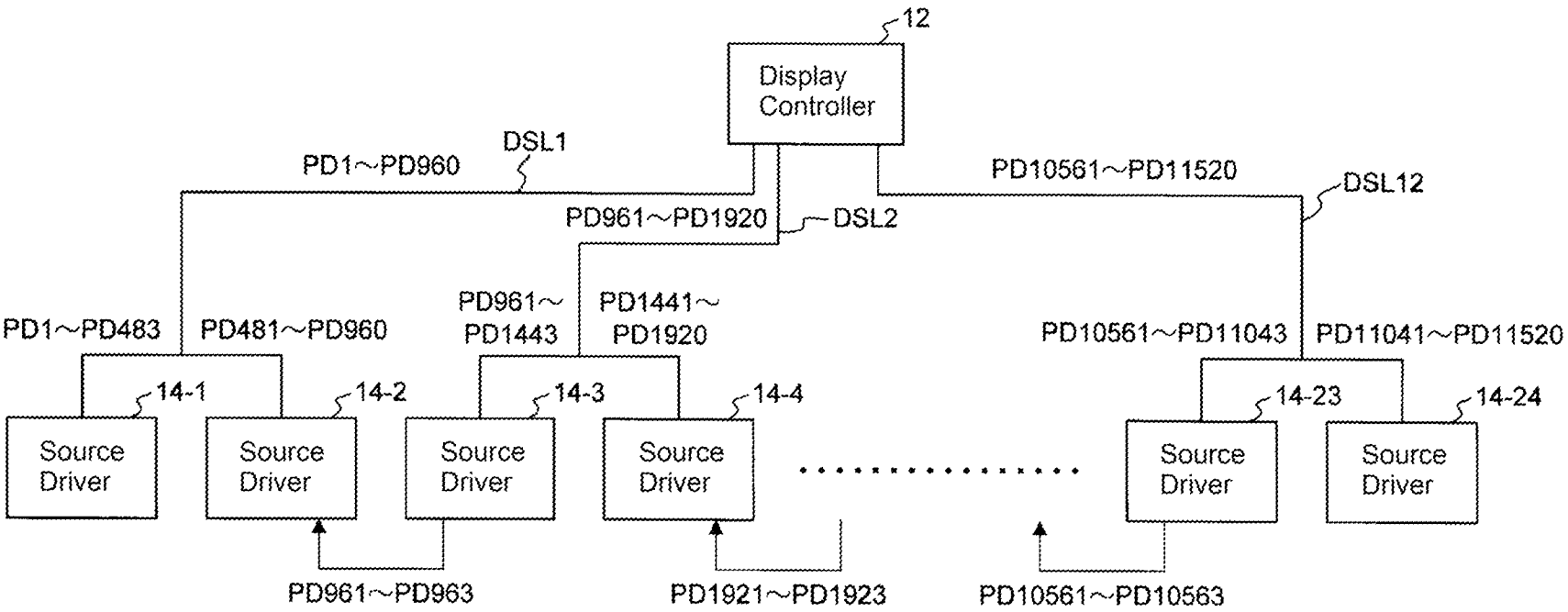
FIG. 2 is a block diagram showing a display controller and source drivers of the present embodiment.

FIG. 2 shows the supply of the pixel data pieces PD between the display controller and the source drivers. Here, a case is shown in which the source drivers compatible with 8K are installed in the display device 100, and the number of source driver ICs is 24 (that is, p=24). In the present embodiment, an example is described in which the direction from the source drivers 14-1 to 14-24 (that is, the left to right direction on the page) is the scanning direction for the screen.

The display controller 12 is a timing controller compatible with 4K, and is connected to the respective source drivers via the 12 data supply lines DSL1 to DSL12. The display controller 12 supplies the pixel data pieces PD for 960 channels each via the data supply lines DSL1 to DSL12.

The source drivers 14-1 to 14-24 are connected to the display controller 12 via common data supply lines for every pair of source drivers. The source drivers 14-1 and 14-2 are connected to the display controller 12 via the common data supply line DSL1, for example. Also, the source drivers 14-3 to 14-4 are connected to the display controller 12 via the common data supply line DSL2. That is, where k is a natural number of 12 or less, the source driver 14-(2k−1) and 14-2k are connected to the display controller 12 via the common data supply line DSLk.

The source drivers 14-1 to 14-24 have the function of so-called up-conversion of generating gradation voltage signals compatible with an 8K display panel on the basis of the pixel data pieces PD compatible with a 4K display panel. Specifically, the latch circuit provided in each of the source drivers 14-1 to 14-24 performs linear interpolation of the pixel data on the basis of a number of pixel data pieces PD that is compatible with 4K display, and generates a number of pixel data pieces PD that is compatible with 8K display.

In order to generate 960 channels of pixel data pieces PD by linear interpolation, there need to be 480 channels of pixel data pieces PD. In addition, pixel data pieces PD corresponding to the boundary portions between adjacent source driver ICs, or in other words, corresponding to the channels at the edges of the driver ICs need to be generated by linear interpolation, and thus, one channel of pixel data pieces PD for each of the RGB colors need to be generated for a total of three channels of pixel data pieces PD. Therefore, each of the source drivers 14-1 to 14-24 needs to receive 483 channels of pixel data pieces PD.

The display controller 12 supplies the pixel data pieces PD1 to PD960 via the data supply line DSL1. The source driver 14-1 is supplied the pixel data pieces PD1 to PD483. Meanwhile, the source driver 14-2 needs the pixel data pieces PD481 to PD963. However, the pixel data pieces PD961 to PD963 are pixel data pieces PD that are supplied to the source driver 14-3 via the data supply line DSL2, and thus, the source driver 14-2 cannot directly receive the supply of pixel data pieces from the display controller 12. In the present embodiment, the source driver 14-2 is configured so as to be able to receive the pixel data pieces PD961 to PD963 from the adjacent source driver 14-3.

Similarly, the source driver 14-4 can receive the pixel data pieces PD1921 to PD1923 from the display controller 12 via the data supply line DSL2. Thus, the source driver 14-4 is configured so as to be able to receive the pixel data pieces PD1921 to PD1923 from the adjacent source driver 14-5 (not shown in FIG. 2). That is, where k is a natural number of 11 or less, the source driver 14-2k is configured so as to be able to receive the pixel data pieces PD(960k+1) to PD(960k+3) from the source driver 14-(2k+1).

Figure 3A:
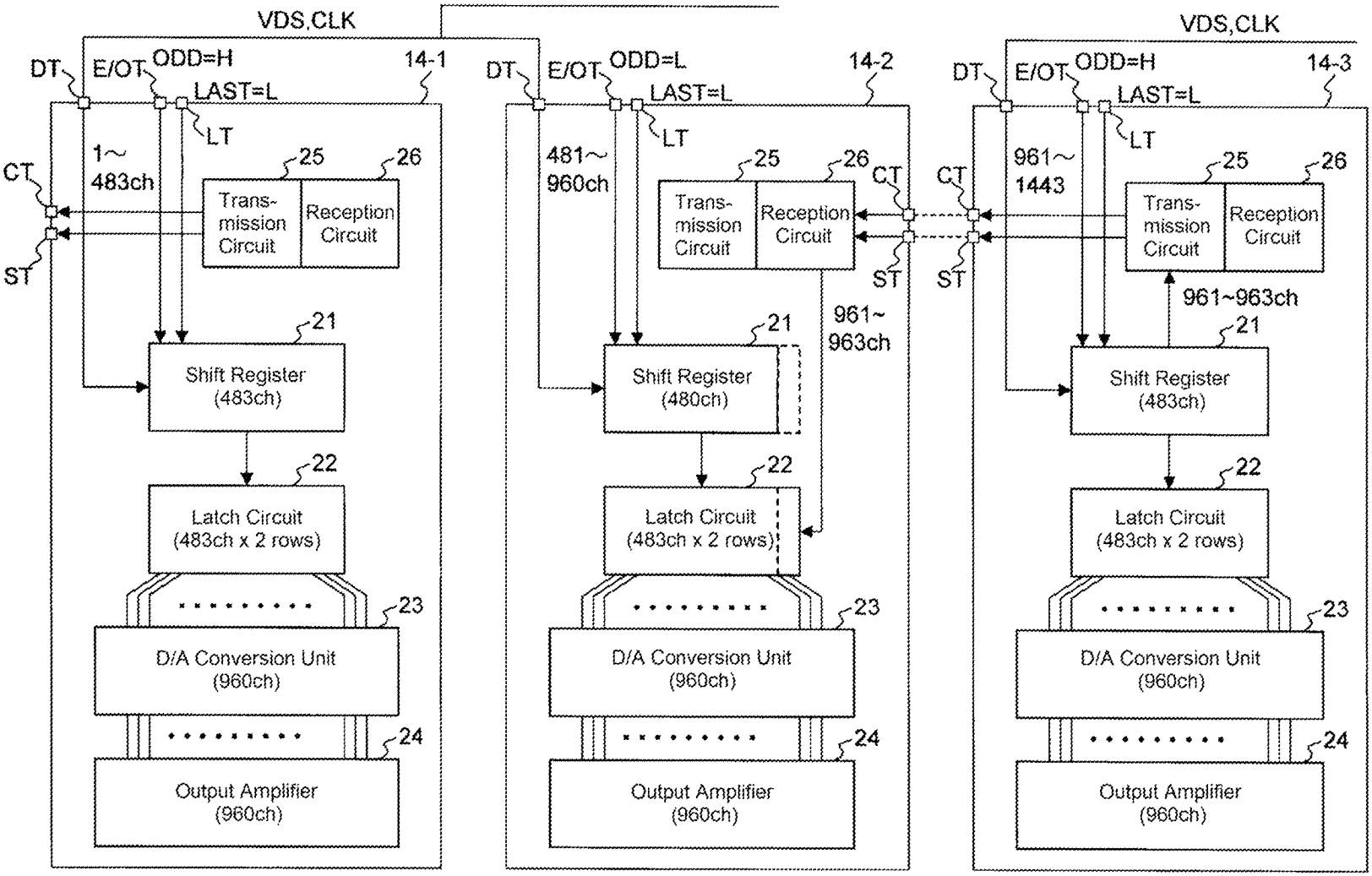
FIG. 3A schematically shows the configuration of the source drivers and transmission/reception of pixel data pieces.

FIG. 3A is a block diagram showing the configuration of the source drivers 14-1, 14-2, and 14-3. The source drivers 14-1, 14-2, and 14-3 each have a shift register 21, a latch circuit 22, a D/A conversion unit 23, an output amplifier 24, a transmission circuit 25, and a reception circuit 26.

The source drivers 14-1 and 14-2 receive the pixel data pieces from the display controller 12 via the common data supply line DSL1. The source driver 14-3 receives the pixel data pieces from the display controller 12 via the data supply line DSL2, which differs from the data supply line DSL1.

The shift register 21 sequentially acquires the sequence of pixel data pieces PD included in the image data signal VDS and outputs the pixel data pieces to the latch circuit 22 as parallel pixel data pieces PD on the basis of the clock signal CLK supplied from the display controller 12.

The shift register 21 of the source driver 14-1 acquires, from the image data signal VDS, a sequence of 1st to 483rd channels of the pixel data pieces PD attained by adding the pixel data pieces for one channel each for R, G, and B (that is, three channels) to the pixel data pieces PD corresponding to the 1st to 480th channels that constitute the first half of the 960 channels, and supplies the sequence of pixel data pieces to the latch circuit 22.

The shift register 21 of the source driver 14-2 acquires, from the image data signal VDS, a sequence of the pixel data pieces PD corresponding to the 481st to 960th channels that constitute the latter half of the 960 channels, and supplies the sequence of pixel data pieces to the latch circuit 22.

The shift register 21 of the source driver 14-3 acquires, from the image data signal VDS, a sequence of 961st to 1443rd channels of the pixel data pieces PD obtained by adding the pixel data pieces for one channel each for R, G, and B (that is, three channels) to the pixel data pieces PD corresponding to the 961st to 1440th channels that constitute the first half of the 961st to 1920th channels, and supplies the sequence of pixel data pieces to the latch circuit 22. Also, the shift register 21 of the source driver 14-3 supplies, to the transmission circuit 25, three channels of the pixel data pieces PD from the head of the acquired sequence of the pixel data pieces PD of the 961st to 1443rd channels, or in other words, the pixel data pieces PD of the 961st to 963rd channels.

The latch circuit 22 acquires the pixel data pieces PD outputted from the shift register 21.

The latch circuit 22 of the source driver 14-1 acquires the pixel data pieces PD of the 1st to 483rd channels outputted from the shift register 21, for example. Similarly, the latch circuit 22 of the source driver 14-3 acquires the pixel data pieces PD of the 961st to 1443rd channels outputted from the shift register 21.

Meanwhile, the latch circuit 22 of the source driver 14-2 acquires the pixel data pieces PD of the 961st to 963rd channels supplied from the reception circuit 26 in addition to acquiring the pixel data pieces PD of the 481st to 960th channels from the shift register 21.

That is, each of the latch circuits 22 of the source drivers 14-1 to 14-3 latch pixel data pieces PD corresponding to 483 channels.

The latch circuit 22 performs linear interpolation of the pixel data in the data line direction (that is, the channel direction) on the basis of the acquired pixel data pieces PD of the 483 channels, and generates 960 channels of pixel data. Also, the latch circuit 22 performs linear interpolation of the pixel data in the scanning line direction (that is, the line direction) for every two rows of the pixel data pieces PD for 483 channels (that is, for two horizontal scanning lines) and generates the pixel data pieces PD for 960 channels corresponding to the row therebetween.

In performing such linear interpolation of the pixel data in the scanning line direction, the pixel data piece group corresponding to the last row does not have a pair of pixel data pieces serving as the basis for linear interpolation, and thus, normal linear interpolation cannot be performed here. Thus, the latch circuit 22 of each source driver performs processing in which the pixel data pieces PD of the penultimate row are copied as is to be the last row of pixel data pieces.

The D/A conversion unit 23 selects a gradation voltage corresponding to the pixel data pieces PD of the 960 channels outputted from the latch circuit 22 (digital/analog conversion), and supplies the gradation voltage as an analog gradation voltage signal to the output amplifier 24.

The output amplifier 24 amplifies the gradation voltage signal selected by the D/A conversion unit 23 and outputs the gradation voltage signal to the data line.

The transmission circuit 25 is a circuit that transmits three channels of the pixel data pieces PD supplied from the shift register 21 to the adjacent source driver. Specifically, the transmission circuit 25 of the source driver 14-3 receives the pixel data pieces PD of the 961st to 963rd channels from the shift register 21 and transmits the pixel data pieces PD of the three channels to the adjacent even-numbered source driver 14-2.

Meanwhile, the transmission circuits 25 of the source drivers 14-1 and 14-2 do not receive the pixel data pieces PD from the shift register 21, and thus, do not transmit the pixel data pieces PD to the adjacent source driver.

The reception circuit 26 is a circuit that receives the pixel data pieces PD for three channels transmitted from the adjacent source driver and supplies the received pixel data pieces PD to the latch circuit 22. Specifically, the reception circuit 26 of the source driver 14-2 receives the pixel data pieces PD for three channels transmitted from the adjacent source driver 14-3 and supplies the received pixel data pieces PD to the latch circuit 22. Meanwhile, the reception circuits 26 of the source drivers 14-1 and 14-3 do not receive the pixel data pieces PD from the adjacent source driver.

The even-numbered source drivers 14-2k (k being a natural number of 11 or less) aside from the last source driver 14-24 have a similar configuration to the source driver 14-2. The odd-numbered source drivers 14-(2k−1) have a similar configuration to the source driver 14-3.

Figure 3B:
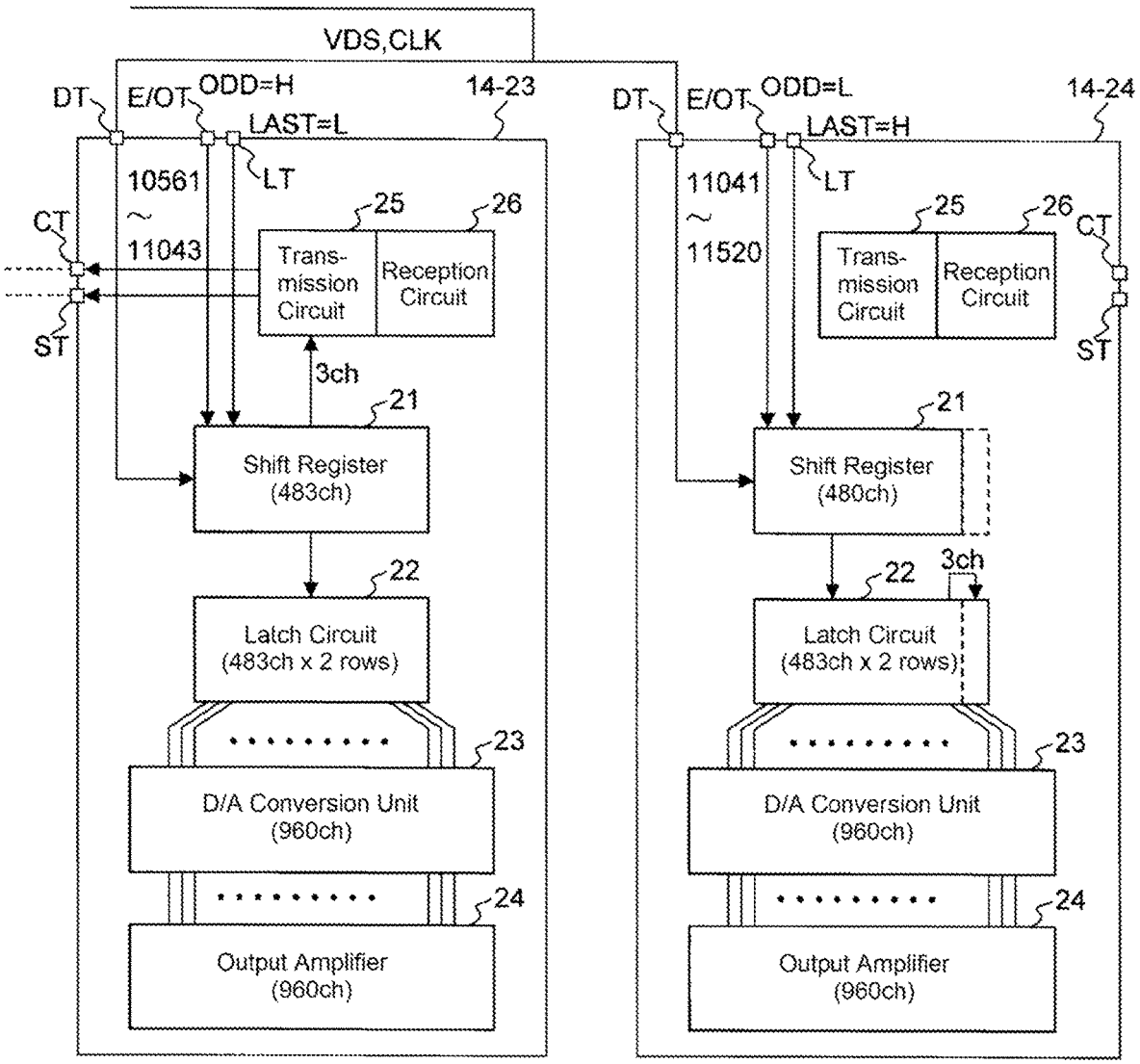
FIG. 3B schematically shows the configuration of the final stage source driver.

FIG. 3B is a block diagram showing the configuration of the source drivers 14-23 and 14-24. The source drivers 14-23 and 14-24 receive the pixel data pieces from the display controller 12 via the common data supply line DSL12.

The source driver 14-23 has a similar configuration to the source driver 14-3. Thus, description thereof is omitted.

The source driver 14-24 is a source driver positioned at the last stage with reference to the scanning direction of the gate lines. The source driver 14-24 has the shift register 21, the latch circuit 22, the D/A conversion unit 23, and the output amplifier 24.

The shift register 21 of the source driver 14-24 acquires, from the image data signal VDS, a sequence of the pixel data pieces PD of the 11041st to 11520th channels that constitute the latter half of the 10561st to 11520th channels, and supplies the sequence of pixel data pieces to the latch circuit 22.

The latch circuit 22 acquires the pixel data pieces PD of the 11041st to 11520th channels (that is, 480 channels) outputted from the shift register 21. Also, the latch circuit 22 generates the pixel data pieces PD of 483 channels on the basis of the acquired pixel data pieces of the 480 channels.

Specifically, the latch circuit 22 of the source driver copies the pixel data pieces PD of the 11518th to 11520th channels, which are the last three channels, among the pixel data pieces of the 11041th to 11520th channels acquired from the shift register 21, and designates these as the pixel data pieces PD of the 11520th to 11523rd channels. As a result, the pixel data pieces PD of the 483 channels are acquired by the latch circuit 22 even in the last source driver 14-24.

The latch circuit 22 performs linear interpolation of the pixel data similarly to the latch circuits 22 of the source drivers 14-1 to 14-3 on the basis of the acquired pixel data pieces PD of the 483 channels, and generates the pixel data pieces PD for 960 channels. Also, the latch circuit 22 performs linear interpolation of the pixel data in the scanning line direction.

The D/A conversion unit 23 and the output amplifier 14 are similar to those of the source drivers 14-1 to 14-3. In the last stage source driver 14-24, the transmission circuit 25 and the reception circuit 26 do not operate.

Returning to FIG. 3A, the source drivers 14-1 to 14-3 each have a data input terminal DT, an even/odd setting terminal E/OT, a last stage setting terminal LT, a clock input/output terminal CT, and a data input/output terminal ST. Also, as shown in FIG. 3B, the source drivers 14-23 and 14-24 also have these terminals.

The even/odd setting terminal E/OT is a terminal that receives input of a setting signal indicating whether the source driver is an even-numbered source driver or an odd-numbered source driver. In the present embodiment, by receiving an L level odd-number setting signal ODD, the source driver is set to be an even-numbered source driver 14-2k. Also, by receiving an H level odd-number setting signal ODD, the source driver is set to be an odd-numbered source driver 14-(2k+1).

The last stage setting terminal LT is a terminal that receives input of a setting signal for setting the source driver as the last stage source driver 14-24. In the present embodiment, by receiving an H level last stage setting signal LAST, the source driver is set to be the last source driver 14-24. On the other hand, by receiving an L level last stage setting signal LAST, the source driver is set to be a source driver other than the last stage source driver.

The data input/output terminal ST is a terminal for performing input/output of data with an external unit when the source drivers transmit/receive the pixel data pieces PD with each other. The transmission circuit 25 of an odd-numbered source driver 14-(2k+1) outputs the pixel data pieces PD for three channels via the data input/output terminal ST to the outside of the source driver. The reception circuit 26 of an even-numbered source driver 14-2k receives the pixel data pieces PD inputted from the outside via the data input/output terminal ST.

The clock input/output terminal CT is a terminal for performing input/output of an inter-driver clock signal CK that is transmitted/received in association with the transmission/reception of the pixel data pieces PD among the source drivers. The inter-driver clock signal CK is generated by a clock signal generating unit (not shown) provided in the source driver on the basis of the clock signal CLK supplied from the display controller 12. The acquisition of the pixel data pieces PD of three channels by the even-numbered source drivers 14-2k is performed in synchronization with the inter-driver clock signal CK.

Next, the operations of the shift register 21, the latch circuit 22, the transmission circuit 25, and the reception circuit 26 in each source driver of the present embodiment will be described.

Figure 4:
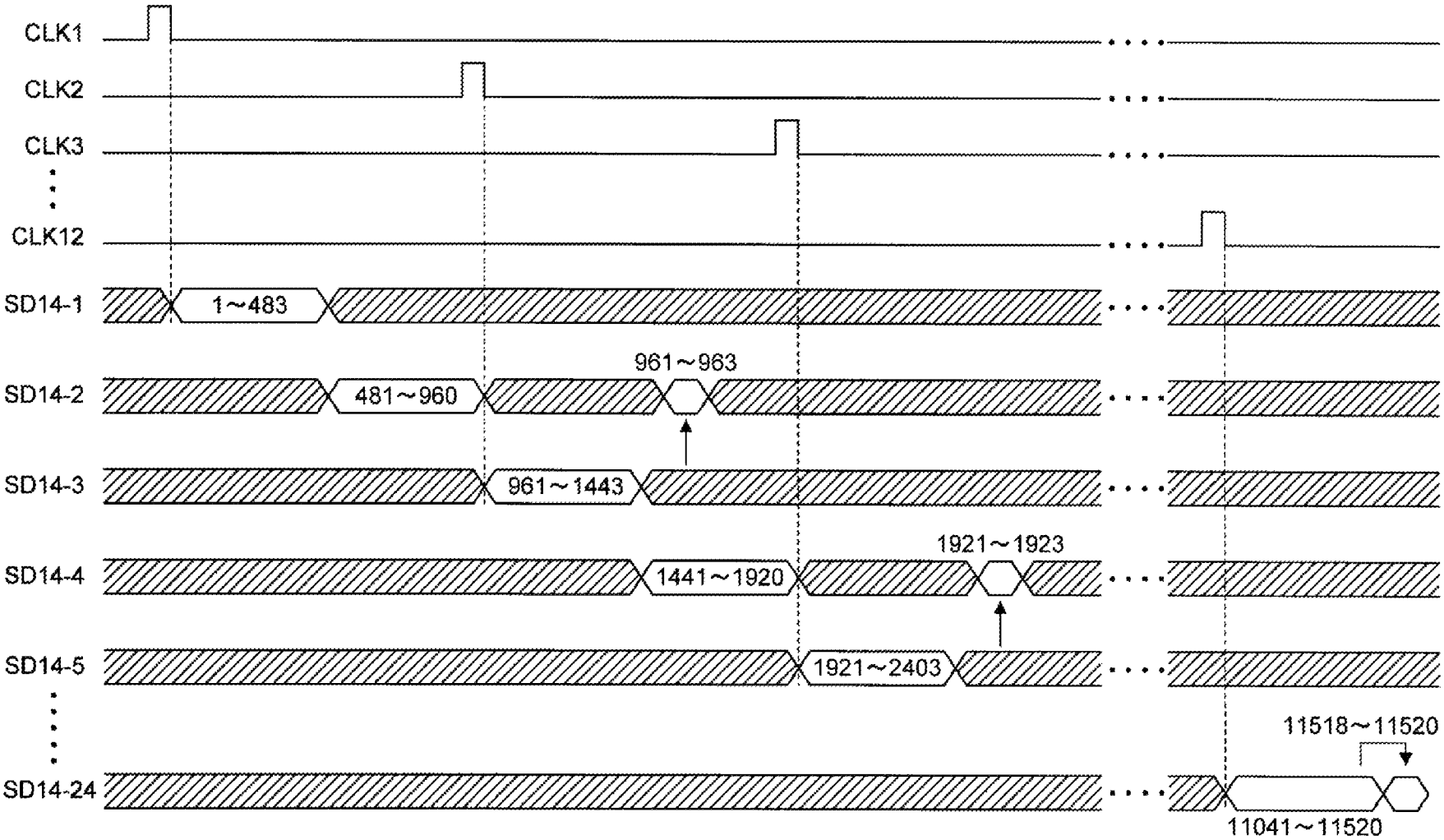
FIG. 4 is a timing chart showing the operation of a latch circuit of each source driver.

FIG. 4 is a timing chart showing the timing for acquiring the pixel data pieces PD by the source drivers 14-1 to 14-24. Here, the clock timings for the clock signal CLK for each of the pixel data pieces PD of 960 channels included in the image data signal VDS are indicated as CLK1, CLK2, CLK3 . . . CLK12. Also, the latch timings for the pixel data pieces PD in the latch circuits 22 of the source drivers 14-1, 14-2, 14-3, 14-4, 14-5, and 14-24 are indicated as SD14-1, SD14-2, SD14-3, SD14-4, SD14-5, and SD14-24. The source drivers 14-6 to 14-23 are not shown.

The shift register 21 of the source driver 14-1 sequentially acquires the pixel data pieces PD corresponding to the 1st to 483rd channels included in the image data signal VDS supplied from the display controller 12 according to the timing at which the CLK1 signal changes, and outputs the pixel data pieces to the latch circuit 22. The latch circuit 22 latches the pixel data pieces PD of the 1st to 483rd channels supplied from the shift register 21.

The shift register 21 of the source driver 14-2 sequentially acquires the pixel data pieces PD corresponding to the 481st to 960th channels included in the image data signal VDS supplied from the display controller 12, and outputs the pixel data pieces to the latch circuit 22. The latch circuit 22 latches the pixel data pieces PD of the 481st to 960th channels supplied from the shift register 21.

The shift register 21 of the source driver 14-3 sequentially acquires the pixel data pieces PD corresponding to the 961st to 1443rd channels included in the image data signal VDS supplied from the display controller 12 according to the timing at which the clock signal CLK2 changes, and outputs the pixel data pieces to the latch circuit 22. The latch circuit 22 latches the pixel data pieces PD of the 961st to 1443rd channels supplied from the shift register 21.

Also, the shift register 21 of the source driver 14-3 supplies, to the transmission circuit 25, pixel data pieces PD of the 961st to 963rd channels, which are the first three channels of the acquired pixel data pieces PD. The transmission circuit 25 transmits the pixel data pieces PD for the 961st to 963rd channels to the adjacent source driver 14-2.

The reception circuit 26 of the source driver 14-2 receives the pixel data pieces PD for three channels transmitted from the adjacent source driver 14-3. The reception circuit 26 supplies the pixel data pieces PD for three channels to the latch circuit 22. The latch circuit 22 latches the pixel data pieces of three channels as the pixel data pieces PD of the 961st to 963rd channels.

The shift register 21 of the source driver 14-4 sequentially acquires the pixel data pieces PD corresponding to the 1441st to 1920th channels included in the image data signal VDS supplied from the display controller 12, and outputs the pixel data pieces to the latch circuit 22. The latch circuit 22 latches the pixel data pieces PD of the 1441st to 1920th channels supplied from the shift register 21.

The shift register 21 of the source driver 14-5 sequentially acquires the pixel data pieces PD corresponding to the 1921st to 2403rd channels included in the image data signal VDS supplied from the display controller 12 according to the timing at which the clock signal CLK3 changes, and outputs the pixel data pieces to the latch circuit 22. The latch circuit 22 latches the pixel data pieces PD of the 1921st to 2403rd channels supplied from the shift register 21.

Also, the shift register 21 of the source driver 14-5 supplies, to the transmission circuit 25, pixel data pieces PD of the 1921st to 1923rd channels, which are the first three channels of the acquired pixel data pieces PD. The transmission circuit 25 transmits the pixel data pieces PD for the 1921st to 1923rd channels to the adjacent source driver 14-4.

The reception circuit 26 of the source driver 14-4 receives the pixel data pieces PD for three channels transmitted from the adjacent source driver 14-5. The reception circuit 26 supplies the pixel data pieces PD for three channels to the latch circuit 22. The latch circuit 22 latches the pixel data pieces of three channels as the pixel data pieces PD of the 1921st to 1923rd channels.

Similarly thereafter, the even-numbered source drivers 14-2k perform similar operations to the source drivers 14-2 and 14-4, and respectively acquire the pixel data pieces PD for 480+3 channels. The odd-numbered source drivers 14-(2k+1) perform similar operations to the source drivers 14-3 and 14-5 respectively acquire the pixel data pieces PD for 483 channels.

The shift register 21 of the last stage source driver 14-24 sequentially acquires the pixel data pieces PD corresponding to the 11041st to 11520th channels included in the image data signal VDS supplied from the display controller 12, and outputs the pixel data pieces to the latch circuit 22. The latch circuit 22 latches the pixel data pieces PD of the 11041st to 11520th channels supplied from the shift register 21.

Also, the latch circuit 22 of the last stage source driver 14-24 copies the pixel data pieces PD of the 11518th to 11520th channels, which are the last three channels, among the pixel data pieces of the 11041th to 11520th channels, and latches these as the pixel data pieces PD corresponding to the 11521st to 11523rd channels.

As described above, according to the display device 100 of the present embodiment, it is possible to obtain the pixel data pieces PD for 483 channels by transmitting and receiving the pixel data pieces of three channels among adjacent source drivers. As a result, each source driver can interpolate the pixel data even at the boundary sections between adjacent source drivers (that is, the edge channels). Thus, according to the display device 100 of the present of embodiments, it is possible to interpolate the pixel data throughout the entire screen of the display panel, and display up-converted images seamlessly.

The present invention is not limited to the embodiments above. In the above embodiment, an example was described in which the direction from the source drivers 14-1 to 14-24, or in other words, the left to right direction on the page of FIG. 2 is the scanning direction for the screen, but the present invention can also be applied to a configuration in which the screen is scanned in the opposite direction thereto.

Figure 5:
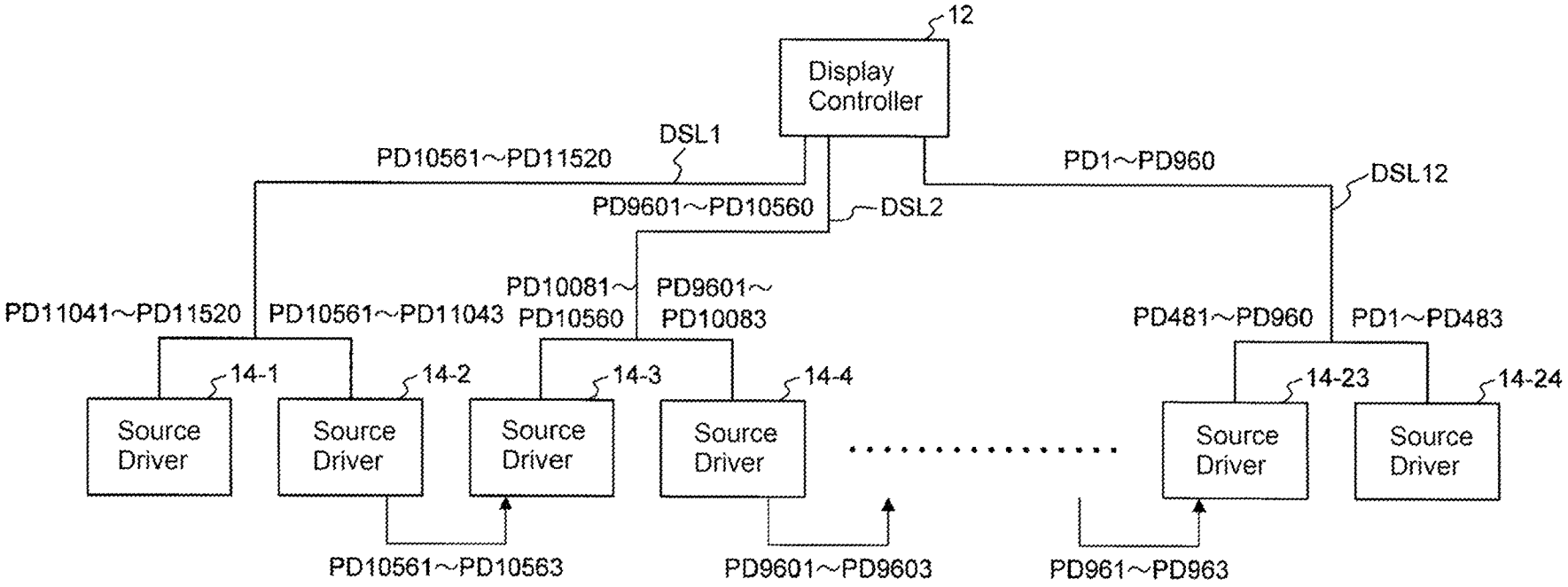
FIG. 5 is a block diagram showing a display controller and source drivers according to a modification example.

FIG. 5 shows the relationship between the supply of the pixel data pieces PD between the display controller 12 and the source drivers for when the screen is scanned in the direction from the source driver 14-24 to the source driver 14-1 (that is, the right to left direction on the page).

The display controller 12 supplies the pixel data pieces PD1 to PD960 via the data supply line DSL12. The source driver 14-24 is supplied the pixel data pieces PD1 to PD483. The source driver 14-23 is supplied the pixel data pieces PD481 to PD960. The source driver 14-23 receives the pixel data pieces PD961 to PD963 from the adjacent source driver 14-22 (not shown).

The display controller 12 supplies the pixel data pieces PD10561 to PD11520 via the data supply line DSL1. The last stage source driver 14-1 is supplied the pixel data pieces PD11041 to PD11520.

Figure 6:
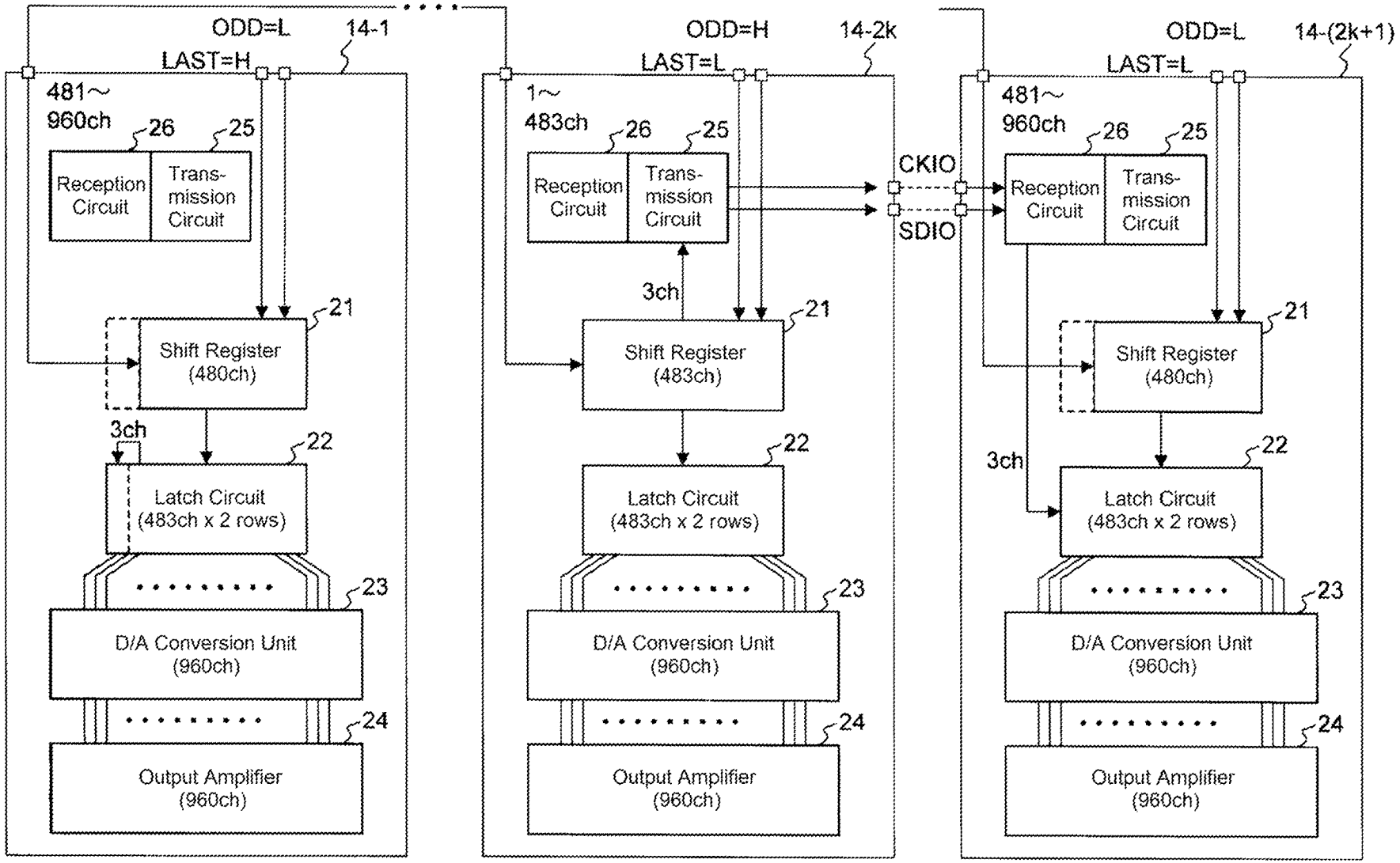
FIG. 6 shows the configuration of each source driver and the supply of image data according to the modification example.

FIG. 6 is a block diagram showing an even-numbered source driver, an odd-numbered source driver, and the last stage source driver in the configuration of FIG. 5. By the even/odd setting terminal E/OT receiving an H level signal, the source driver 14-2k is set to be an odd-numbered source driver. Also, by the even/odd setting terminal E/OT receiving an L level signal, the source driver 14-(2k+1) is set to be an even-numbered source driver. Also, by the last stage setting terminal LT receiving an H level signal, the source driver 14-1 is set to be the last stage source driver.

In the embodiment above, a configuration for interpolating pixel data was described with a case in which 4K image content is displayed in an 8K display panel as an example. However, the present invention is not limited thereto and can be applied to various cases in which interpolation of pixel data is necessary. For example, the display driver of the present invention may be used as a display driver for displaying conventional high-definition broadcast content in a 4K display panel.

Thus, the present invention is not limited to a case, such as that described in the embodiment above, in which the display controller 12 supplies pixel data pieces PD for 960 channels at a time via 12 data supply lines. That is, if the number of data supply lines is j, the number of source drivers is 2j, and the pixel count in the gate line direction of the display panel is m, then the display controller outputs pixel data piece groups formed by dividing m/2 pixel data pieces sequentially into j pixel data pieces from the start, or in other words, m/(2j) pieces of pixel data to the data supply line. The source driver 14-2k, which is an even-numbered source driver, receives m/(4j) pixel data pieces from the display controller via the data supply lines, receives pixel data pieces for three channels (that is, the pixel data pieces corresponding to each channel of R, G, and B) from the source driver 14-(2k+1) that is adjacent to the aforementioned source driver and that is connected to the display controller via a differing data supply line, and on the basis thereof, generates m/(2j) gradation voltage signals.

Also, there is no limitation to the interpolation method for the pixel data by the latch circuits 22 of the source drivers 14-1 to 14-*p*. The linear interpolation or the like described in the above embodiment may be of any configuration as long as, on the basis of two adjacent pixel data pieces in the pixel data piece group, the pixel data therebetween is interpolated.

The embodiment above describes cases in which the display device 100 is a liquid crystal display device, but an organic EL (electroluminescence) display device may instead by used.

What is claimed is:

1. A display device, comprising:

a display panel having m data lines and n gate lines, m being a multiple of 12 greater than or equal to 24, and n being an integer of 2 or greater, and m×n pixel units provided in a matrix at respective intersections between the m data lines and the n gate lines;

a gate driver configured to supply scan signals that control the pixel switches to be ON during a selection period based on a pulse width to the n gate lines;

a source driver group that is constituted of 2j source drivers, j being an integer of 2 or greater, arranged along a lengthwise direction of the gate lines, and that is configured to receive one frame of an image data signal formed by a sequence of a plurality of pixel data piece groups that each include m/2 pixel data pieces that each cover R, G, and B pixels and to generate gradation voltage signals to be supplied to the m×n pixel units on the basis of the image data signal;

j data supply lines provided in common among pairs of adjacent source drivers that constitute the source driver group; and a display controller that is connected to the 2j source drivers via the j data supply lines, and that is configured to output the image data signal to the j data supply lines for each of pixel data piece groups formed by sequentially splitting the m/2 pixel data pieces into j groups, wherein the pair of source drivers is constituted of a (2k−1)th source driver and a (2k)th source driver (k being a natural number of (j−1) or less), and wherein the (2k)th source driver receives m/(4j) pixel data pieces from the display controller via a data supply line, receives three pixel data pieces that cover the R, G, and B pixels of a (2k+1)th source driver that is adjacent to the (2k)th source driver and that is connected to the display controller via a differing data supply line, and generates m/(2j) of the gradation voltage signals on the basis of the m/(4j) pixel data pieces and the three pixel data pieces.

2. The display device according to claim 1, wherein the (2k+1)th source driver receives m/(4j)+3 pixel data pieces from the display controller via the data supply line, supplies first three pixel data pieces among the m/(4j)+3 pixel data pieces to the (2k)th source driver, and generates m/(2j) of the gradation voltage signals on the basis of the m/(4j)+3 pixel data pieces.

3. The display device according to claim 1, wherein, among the 2j source drivers, a (2j)th source driver positioned at a last stage with reference to a scanning direction of the gate lines receives m/(4j) pixel data pieces from the display controller via the data supply line, adds same pixel data pieces as three pixel data pieces of the m/(4j) pixel data pieces to the m/(4j) pixel data pieces to generate m/(4j)+3 pixel data pieces, and generates m/(2j) of the gradation voltage signals on the basis of the m/(4j)+3 pixel data pieces.

4. The display device according to claim 1, wherein each of the 2j source drivers includes:

a transmission/reception circuit configured so as to be able to transmit/receive pixel data pieces to and from adjacent source drivers; and a latch circuit configured to latch pixel data pieces supplied from the display controller via the data supply line and the pixel data pieces received by the transmission/reception circuit to perform an interpolation process on the latched pixel data pieces, and on the basis of a plurality of the latched pixel data pieces that have undergone the interpolation process, generate the gradation voltage signals.

5. The display device according to claim 1, wherein each of the 2j source drivers generates n pixel data piece groups by performing interpolation of pixel data in an arrangement direction of the n gate lines on the basis of n/2 pixel data piece groups, thereby generating gradation voltage signals to be supplied to (m/2j)×n pixel units.

6. A source driver that is connected to a display panel having a plurality of data lines and a plurality of gate lines and a plurality of pixel units provided in a matrix at each intersection of the plurality of data lines and the plurality of gate lines, a plurality of the source drivers being arranged adjacent to each other in a lengthwise direction of the gate lines, the source driver being configured to receive an image data signal including a plurality of pixel data pieces via a data supply line, and the source driver being configured to generate a gradation voltage signal on the basis of the image data signal, the source driver comprising:

a shift register configured to sequentially acquire the plurality of pixel data pieces from the image data signal supplied via the data supply line;

a transmission/reception circuit configured so as to be able to transmit/receive the pixel data pieces to and from adjacent source drivers;

a latch circuit configured to latch pixel data pieces outputted from the shift register and pixel data pieces received by the transmission/reception circuit to perform an interpolation process on the basis of the latched pixel data pieces;

an output circuit configured to generate and output gradation voltage signals, on the basis of pixel data pieces that have undergone the interpolation process; and a setting input terminal configured to receive input of a mode setting signal that sets an operation mode to a first mode or a second mode, wherein, in response to the first mode being set, the transmission/reception circuit receives pixel data pieces transmitted from an adjacent source driver, and the latch circuit performs the interpolation process on the basis of the plurality of pixel data pieces supplied via the data supply line and the pixel data pieces received by the transmission/reception circuit, and wherein, in response to the second mode being set, the transmission/reception circuit transmits, to the adjacent source driver, some of the plurality of pixel data pieces supplied via the data supply line, and the latch circuit performs the interpolation process on the basis of the plurality of pixel data pieces supplied via the data supply line.

7. The source driver according to claim 6, further comprising:

a third mode setting input terminal configured to receive input of a mode setting signal that sets the operation mode to a third mode, wherein, in response to the third mode being set, the latch circuit latches the plurality of pixel data pieces acquired by the shift register from the data supply line and additionally latches said some of the plurality of pixel data pieces, and performs the interpolation process on the pixel data pieces on the basis of the latched plurality of pixel data pieces and said some of the plurality of pixel data pieces that were additionally latched.

8. A source driver that is connected to a display panel having a plurality of data lines and a plurality of gate lines and a plurality of pixel units provided in a matrix at each intersection of the plurality of data lines and the plurality of gate lines, a plurality of the source drivers being arranged adjacent to each other in a lengthwise direction of the gate lines, the source driver being configured to receive an image data signal including a plurality of pixel data pieces via a data supply line, and the source driver being configured to generate a gradation voltage signal on the basis of the image data signal, the source driver comprising:

a shift register configured to sequentially acquire the plurality of pixel data pieces from the image data signal supplied via the data supply line;

a transmission/reception circuit configured so as to be able to transmit/receive the pixel data pieces to and from adjacent source drivers;

a latch circuit configured to latch pixel data pieces outputted from the shift register and pixel data pieces received by the transmission/reception circuit to perform an interpolation process on the basis of the pixel data pieces outputted from the shift register and the pixel data pieces received by the transmission/reception circuit; and an output circuit configured to generate and output gradation voltage signals, on the basis of pixel data pieces that have undergone the interpolation process.

* * * * *